US010745960B1

(12) United States Patent
Hutchins

(10) Patent No.: US 10,745,960 B1
(45) Date of Patent: Aug. 18, 2020

(54) WINDOW TRIM SYSTEM

(71) Applicant: John B. Hutchins, Dunedin, FL (US)

(72) Inventor: John B. Hutchins, Dunedin, FL (US)

( * ) Notice: Subject to any disclaimer, the term of this patent is extended or adjusted under 35 U.S.C. 154(b) by 0 days.

(21) Appl. No.: 16/180,909

(22) Filed: Nov. 5, 2018

Related U.S. Application Data

(60) Provisional application No. 62/618,140, filed on Jan. 17, 2018.

(51) Int. Cl.

| | |
|---|---|
| ***E06B 1/62*** | (2006.01) |
| ***E06B 1/26*** | (2006.01) |
| ***E06B 1/70*** | (2006.01) |
| ***E06B 1/34*** | (2006.01) |
| *E04F 19/02* | (2006.01) |

(52) U.S. Cl.
CPC ..... *E06B 1/62* (2013.01); *E06B 1/342* (2013.01); *E06B 1/705* (2013.01); *E04F 19/02* (2013.01); *E06B 1/26* (2013.01); *E06B 2001/628* (2013.01)

(58) Field of Classification Search
CPC ..... E06B 1/62; E06B 1/26; E06B 1/34; E04F 13/0864; E04F 19/061; E04F 19/02
See application file for complete search history.

(56) References Cited

U.S. PATENT DOCUMENTS 5,022,204 A * 6/1991 Anderson ..... E06B 1/62 49/504
5,222,345 A * 6/1993 Riley ..... E06B 1/34 52/716.1
6,112,481 A * 9/2000 Schiedegger ..... E06B 1/34 52/204.53
6,482,500 B1 * 11/2002 Diginosa ..... E04F 19/02 428/121
6,988,345 B1 * 1/2006 Pelfrey ..... E04F 13/0864 52/519
8,511,012 B2 * 8/2013 Scalzi ..... E04F 19/061 52/204.53
2002/0112423 A1 * 8/2002 Schiedegger ..... E04F 19/02 52/211
2007/0094958 A1 * 5/2007 Rogers ..... E06B 1/62 52/211
2012/0031023 A1 * 2/2012 Scalzi ..... E06B 1/26 52/211
2013/0263536 A1 * 10/2013 Peck ..... E06B 1/34 52/211

FOREIGN PATENT DOCUMENTS

DE 102010004254 A1 * 7/2011 ..... E06B 9/323

* cited by examiner

*Primary Examiner* — Phi D A

(57) ABSTRACT

A first section is in facing contact with an exterior surface of a building. A second section is bent to extend exteriorly from the exterior surface at 90 degrees from the first section. A third section is bent at 90 degrees from the second section. A fourth section is bent at 180 degrees from the third section. A portion of the fourth section is in facing contact with the third section. A fifth section extends laterally and interiorly from the fourth section at an acute angle. A sixth section extends laterally from the fifth section parallel with the first and third and fourth sections. A seventh section is bent to extend interiorly at 90 degrees from the sixth section.

1 Claim, 10 Drawing Sheets

FIG. 2
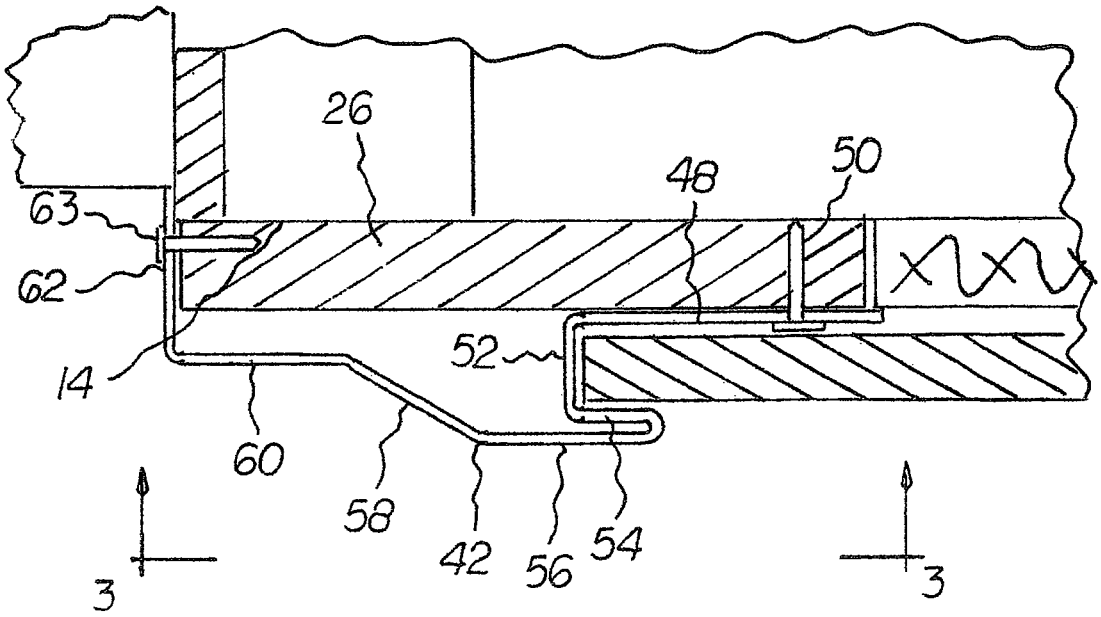
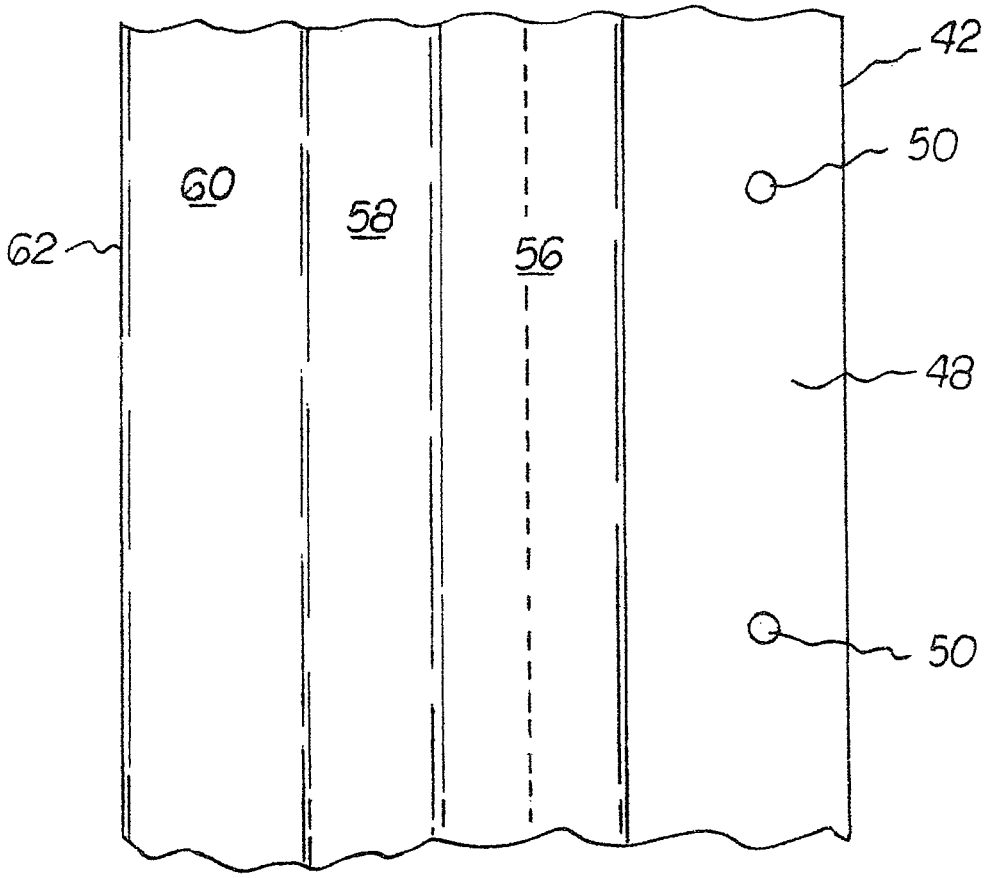
FIG. 3

FIG. 6
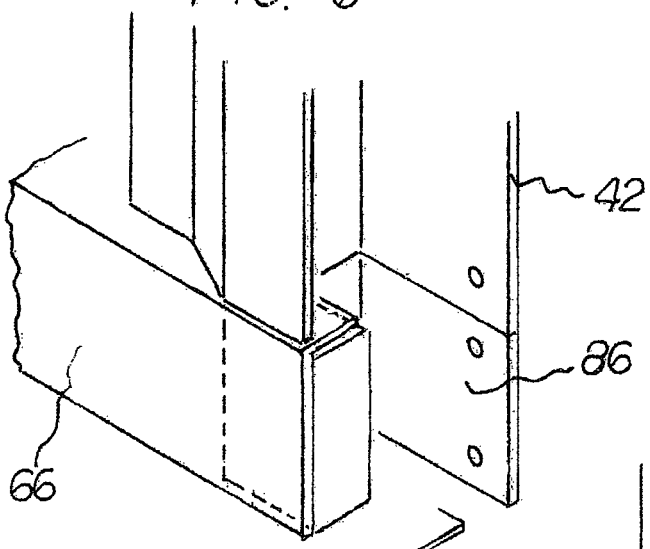
FIG. 8
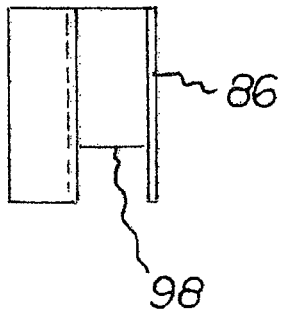
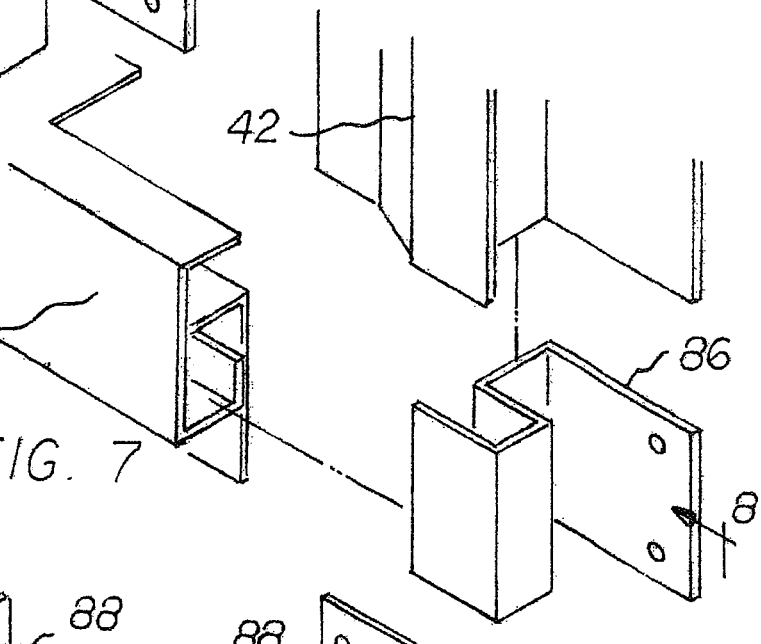
FIG. 7
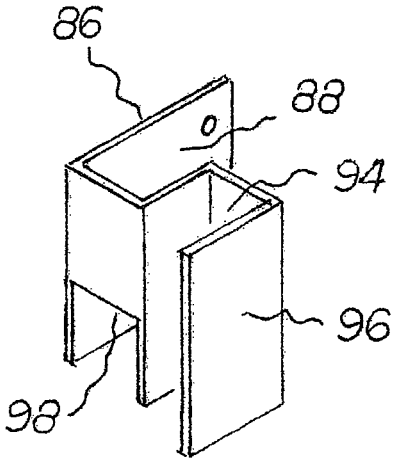
FIG. 9
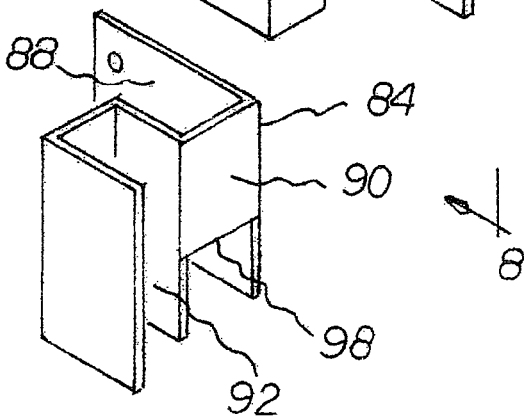
FIG. 10

FIG. 11
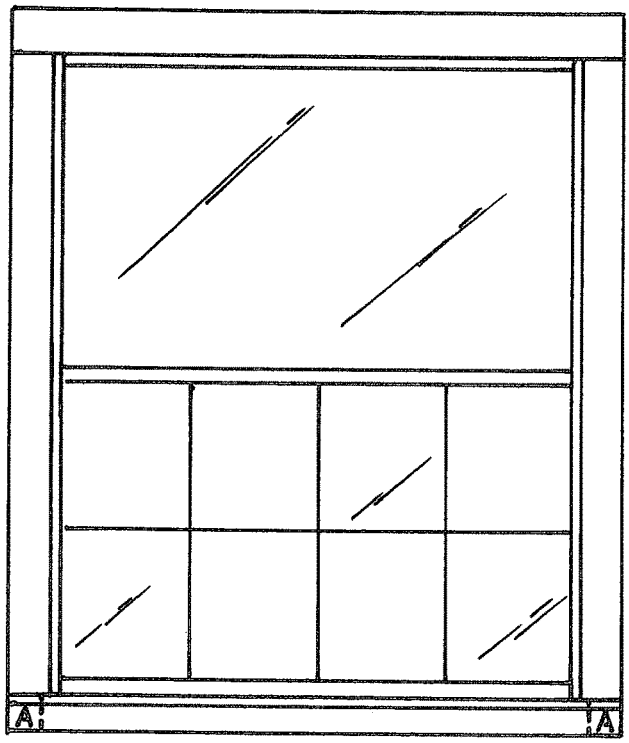
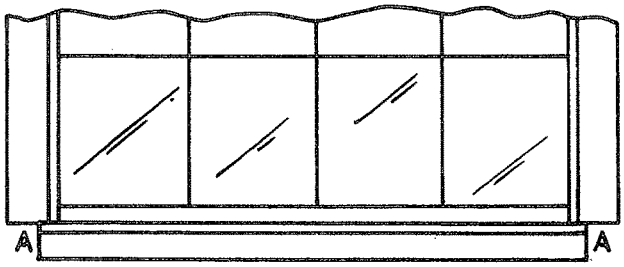
FIG. 12
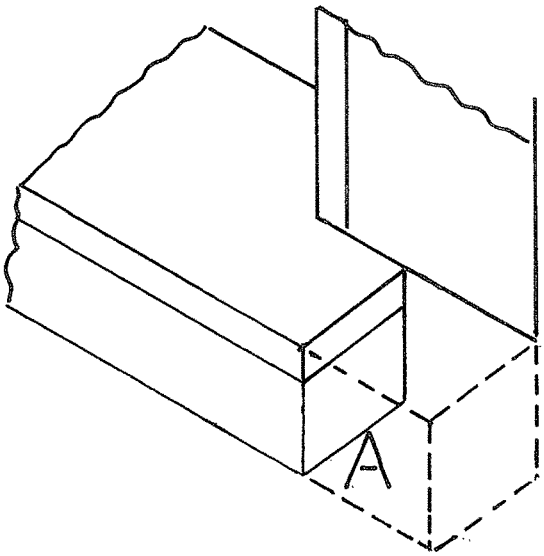
FIG. 13

FIG.14
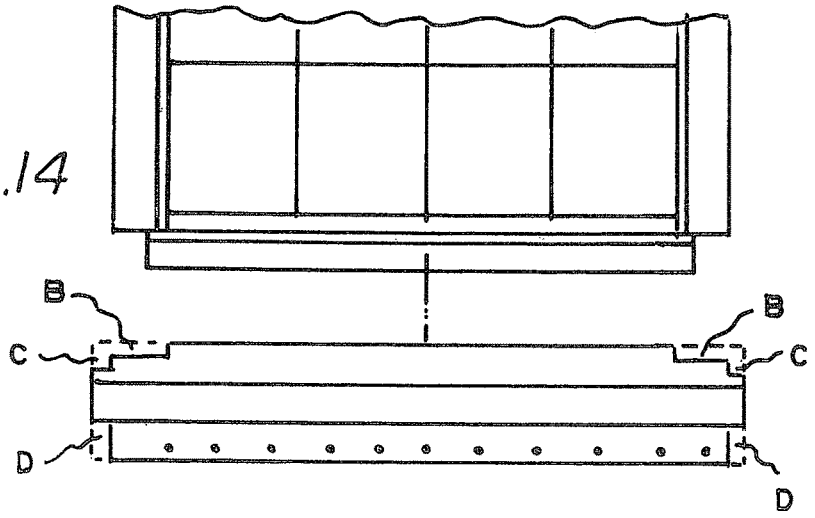
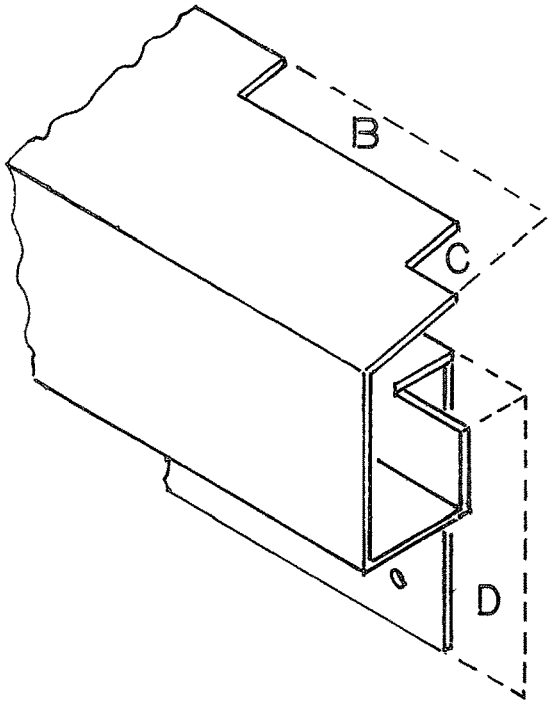
FIG. 15
FIG. 16
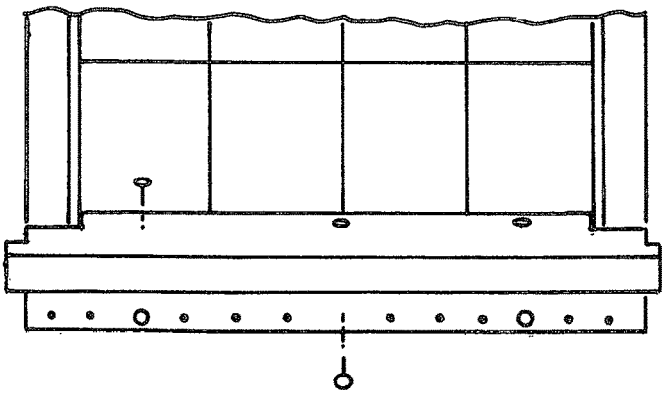

FIG. 17
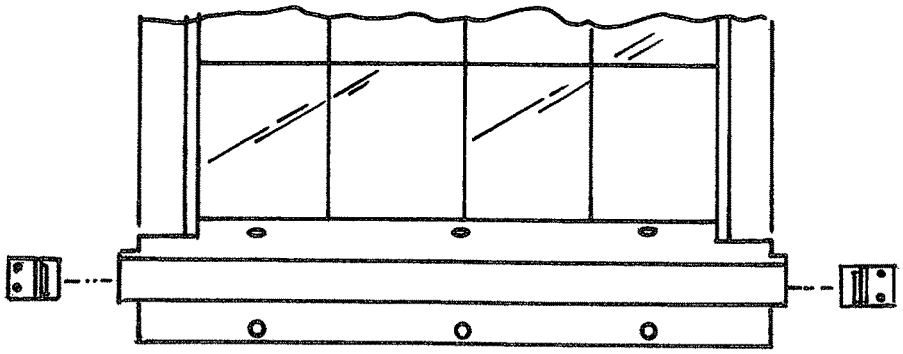
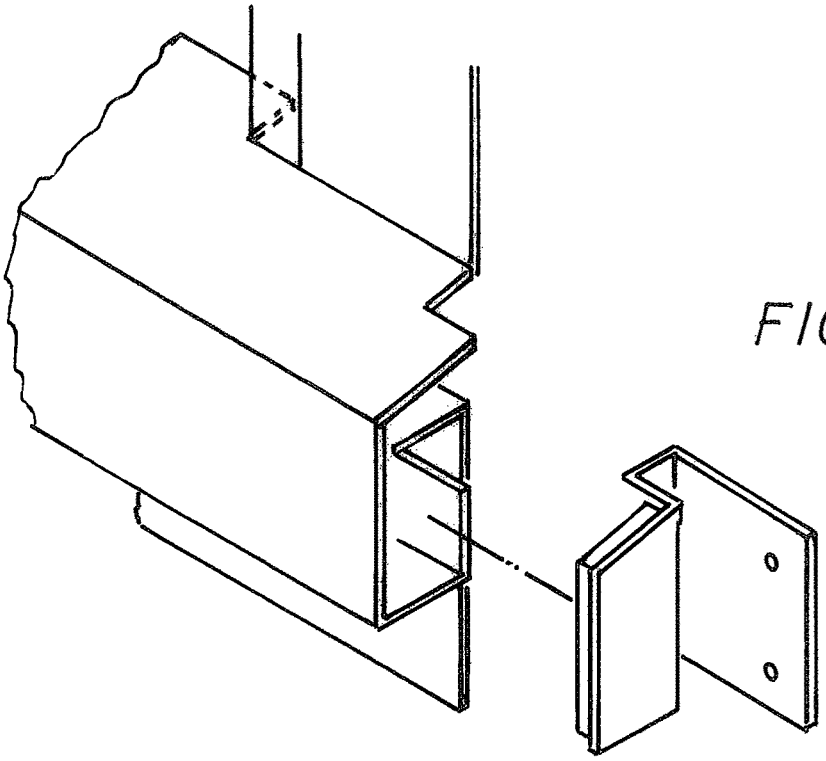
FIG. 18
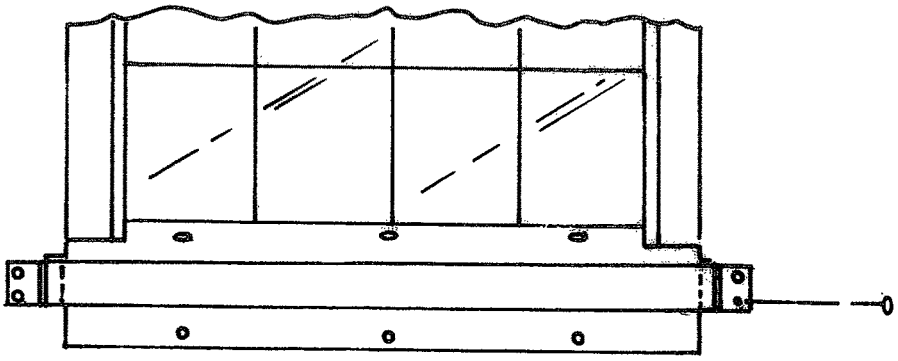
FIG. 19

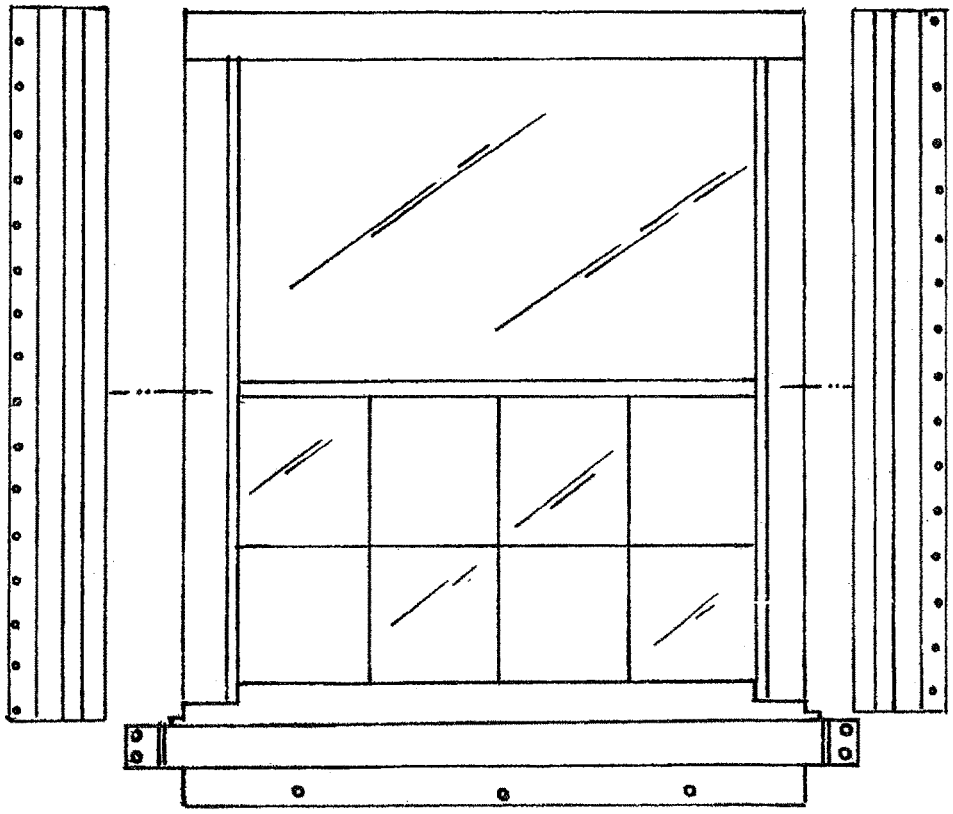
FIG. 20
FIG. 21
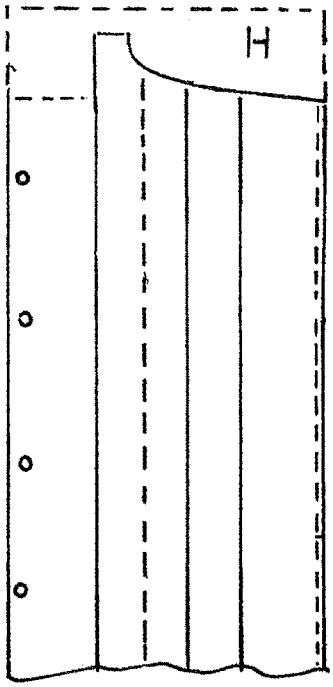
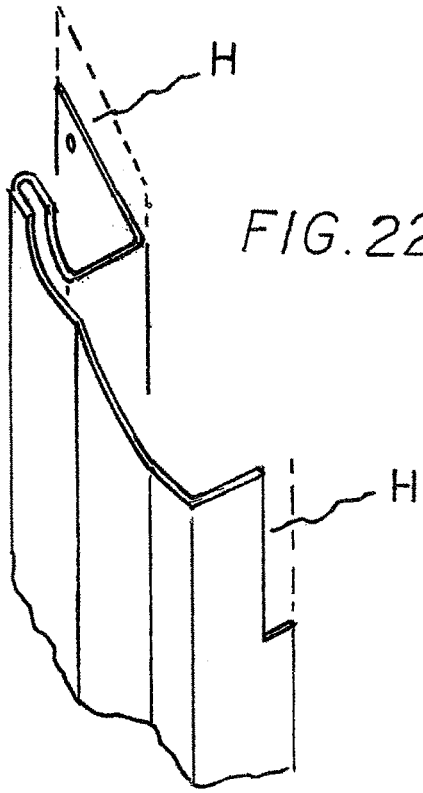
FIG. 22

FIG. 23
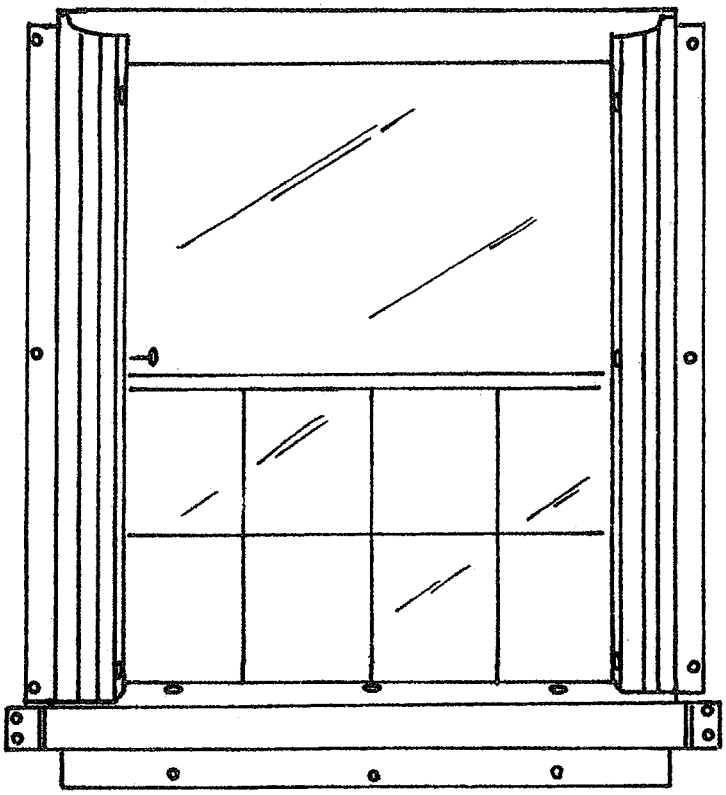
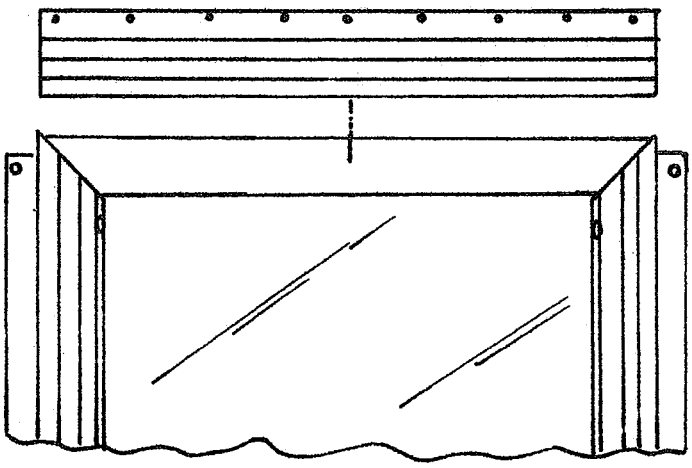
FIG. 24

WINDOW TRIM SYSTEM

RELATED APPLICATION

This non-provisional utility patent application is based upon Provisional Application No. 62/618,140 filed Jan. 17, 2018, the subject matter of which is incorporated herein by reference and the priority of which is claimed.

BACKGROUND OF THE INVENTION

Field of the Invention

The present invention relates to a window trim system and more particularly pertains to installing and supporting trim and siding on a building in proximity to a window. The installing and the supporting are done in a structurally enhanced and eye-appealing manner for covering the peripheral region adjacent to the window with enlarged and contoured trim.

The use of window trims of known designs and configurations is known in the prior art. More specifically, window trims of known designs and configurations previously devised and utilized for the purpose of installing and supporting trim and siding on a building in proximity to a window are known to consist basically of familiar, expected, and obvious structural configurations, notwithstanding the myriad of designs encompassed by the crowded prior art which has been developed for the fulfillment of countless objectives and requirements.

Description of the Prior Art

The use of window trim systems of known designs and configurations is known in the prior art. More specifically, window trim systems of known designs and configurations of known designs and configurations previously devised and utilized for the purpose of trimming windows are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a window trim system that allows installing and supporting trim and siding on a building in proximity to a window in a structurally enhanced and eye-appealing manner for covering the peripheral region adjacent to the window with enlarged and contoured trim.

In this respect, the window trim system according to the present invention substantially departs from the conventional concepts and designs of the prior art, and in doing so provides an apparatus primarily developed for the purpose of installing and, supporting trim and siding on a building in proximity to a window in a structurally enhanced and eye-appealing manner for covering the peripheral region adjacent to the window with enlarged and contoured trim.

Therefore, it can be appreciated that there exists a continuing need for a new and improved window trim system which can be used for installing and supporting trim and siding on a building in proximity to a window in a structurally enhanced and eye-appealing manner for covering the peripheral region adjacent to the window with enlarged and contoured trim. In this regard, the present invention substantially fulfills this need.

SUMMARY OF THE INVENTION

In view of the disadvantages inherent in the known types of window trims of known designs and configurations now present in the prior art, the present invention provides an improved window trim system. As such, the general purpose of the present invention, which will be described subsequently in greater detail, is to provide a new and improved window trim system and method which has all the advantages of the prior art and none of the disadvantages.

To attain this, in a broad context, the present invention essentially comprises seven sections. First provided is a first section in facing contact with an exterior surface of a building. Next provided is a second section bent to extend exteriorly from the exterior surface at 90 degrees from the first section. Next, provided is a third section bent at 90 degrees from the second section. Next provided is a fourth section bent at 180 degrees from the third section. A portion of the fourth section is in facing contact with the third section. Next provided is a fifth section extending laterally and interiorly from the fourth section at an acute angle. Next provided is a sixth section extending laterally from the fifth section parallel with the first and third and fourth sections. Lastly, a seventh section is provided bent to extend interiorly at 90 degrees from the sixth section.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved window trim system which has all of the advantages of the prior art window trim systems of known designs and configurations of known designs and configurations and none of the disadvantages.

It is another object of the present invention to provide a new and improved window trim system which may be easily and efficiently manufactured and marketed.

It is further object of the present invention to provide a new and improved window trim system which is of durable and reliable constructions.

An even further object of the present invention is to provide a new and improved window trim system which is susceptible of a low cost of manufacture with regard to both materials and labor, and which accordingly is then susceptible of low prices of sale to the consuming public, thereby making such window trim system economically available to the buying public.

Lastly, it is another object of the present invention is to provide a window trim system which can be used for installing and supporting trim and siding on a building in proximity to a window. The installing and the supporting are done in a structurally enhanced and eye-appealing manner for covering the peripheral region adjacent to the window with enlarged and contoured trim.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a cross sectional view taken along line 2-2 of FIG. 1.

FIG. 3 is a front elevational view taken along line 3-3 of FIG. 2 but with the siding removed.

FIG. 6 is an enlarged perspective illustration of the lower right corner of the system taken at circle 6 of FIG. 1.

FIG. 7 is an exploded perspective illustration of the sill piece shown in FIGS. 1, 4, and 6 and the right side piece and the left side piece.

FIG. 8 is a front elevational view of the right end cap taken along line 8-8 of FIG. 7.

FIG. 9 is a perspective illustration of the right end cap.

FIG. 10 is a perspective illustration of the left end cap.

FIG. 11 is a front elevational view of a window adapted to receive vinyl siding bottom in accordance with the principles of the present invention, the window being marked with areas A to be cut.

FIG. 12 is a front elevational view of the lower region of the window of FIG. 11 with areas A removed.

FIG. 13 is a perspective view of the lower right region of the window of FIG. 12 with area A removed.

FIG. 14 is an exploded front elevational view of the lower region of the window of FIG. 12 with a vinyl siding bottom there beneath, the vinyl siding bottom being marked with areas B and C and D having been cut.

FIG. 15 is a perspective view of the right end of the vinyl siding bottom of FIG. 14.

FIG. 16 is a front elevational view of the lower region of the window of FIG. 14 but with the vinyl siding bottom nailed thereto.

FIG. 17 is an exploded front elevational view of the lower region of the window and vinyl siding bottom of FIG. 16 but with end caps adjacent thereto.

FIG. 18 is an exploded perspective view of the right region of the vinyl siding bottom and end cap of FIG. 17.

FIG. 19 is a front elevational view of the lower region of the window and vinyl siding bottom of FIG. 17 with end caps adjacent thereto and with coupling nails.

FIG. 20 is an exploded front elevational view of a window adapted to receive vinyl siding sides.

FIG. 21 is a front elevational view of the left vinyl siding side marked with areas H having been cut.

FIG. 22 is a perspective view of the left vinyl siding side of FIG. 21 but with area H having been removed.

FIG. 23 is a front elevational view of the window of FIG. 20 but with the vinyl siding sides nailed thereto.

FIG. 24 is an exploded front elevational view of the top region of the window of FIG. 23 with a vinyl siding top there above.

The same reference numerals refer to the same parts throughout the various Figures.

DESCRIPTION OF THE PREFERRED EMBODIMENT

Figure 1:
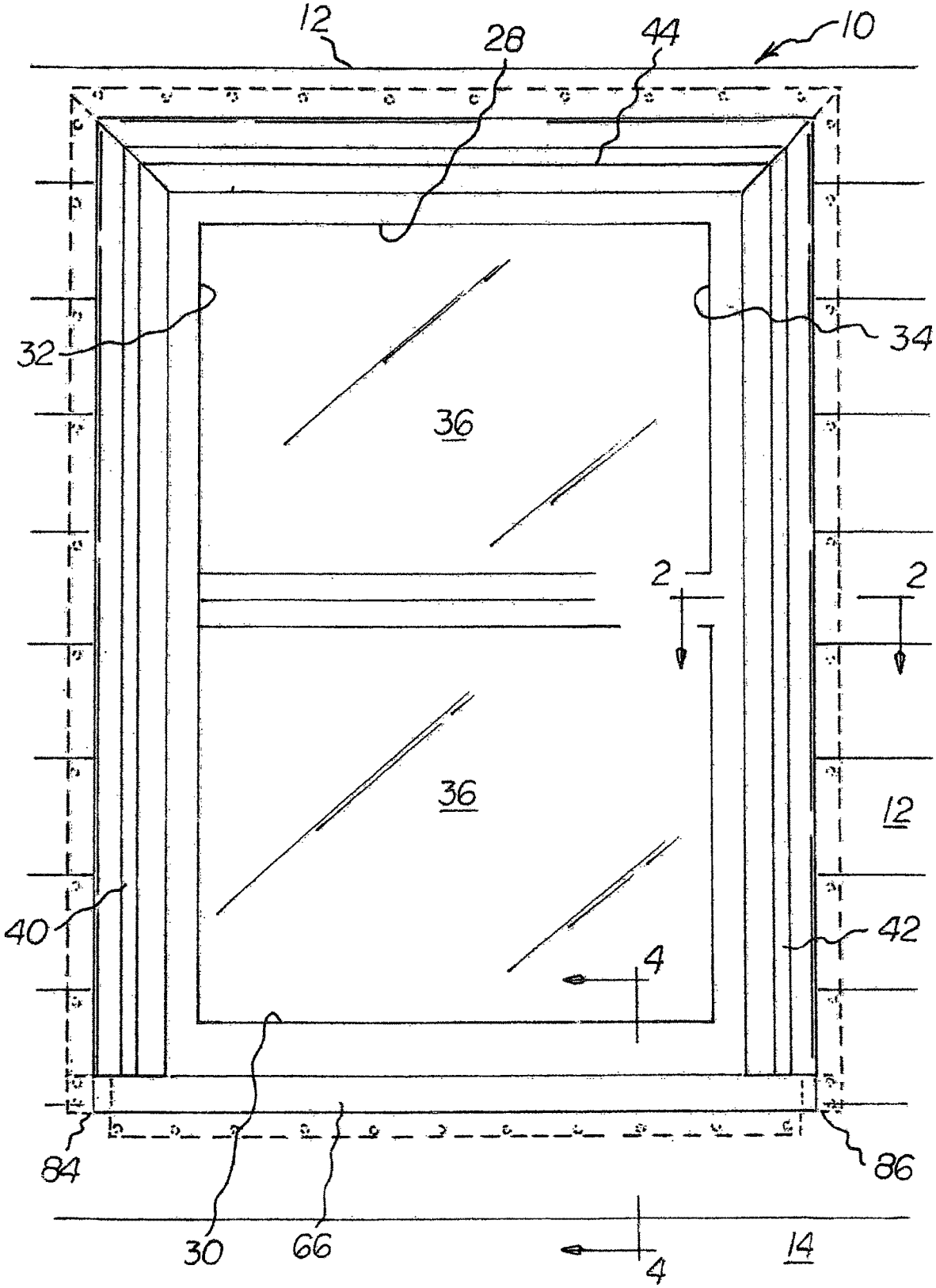
FIG. 1 is a front elevational view of a window trim system constructed in accordance with the principles of the present invention.

With reference now to the drawings, and in particular to FIG. 1 thereof, the preferred embodiment of the new and improved window trim system embodying the principles and concepts of the present invention and generally designated by the reference numeral 10 will be described.

The present invention, the window trim system 10 is comprised of a plurality of components. Such components in their broadest context include a first, a second, a third, a fourth, a fifth, a sixth, and a seventh section. Such components are individually configured and correlated with respect to each other so as to attain the desired objective.

The window trim system 10 of the present invention is for installing and supporting trim and siding 12 on a building 14 in proximity to a window 16. The installing and the supporting are done in a structurally enhanced and eye-appealing manner for covering the peripheral region adjacent to the window with enlarged and contoured trim. In the preferred embodiment, first provided is the building 14. The building has a vertical wall with a window opening 20 in a rectangular configuration. The window opening has an outwardly extending sill 22 below. The vertical wall has an interior surface 24 and an exterior surface 26. The window opening has an upper edge 28, a lower edge 30, a left edge 32 and a right edge 34. A pane of glass 36 is supported within the window opening and constitutes the window of the building.

Next provided is a left side piece 40 coupled to the left edge of the window opening. A similarly configured right side piece 42 is coupled to the right edge of the window opening. A similarly configured top piece 44 is coupled to the top edge of the window opening. The top piece and the left side piece and right side piece terminate at 45 degrees. The left side piece and the right side piece and the top piece 40, 42, 44 are bent to form a plurality of sections. Note FIG. 2.

The plurality of sections include a first section 48 in facing contact with the exterior surface of the vertical wall. Roofing nails 50 secure the first section to the exterior surface of the vertical wall. The first section has a first length.

The plurality of sections also include a second section 50 bent to extend exteriorly from the exterior surface of the vertical wall at 90 degrees from the first section. The second section has a second length less than the first length.

The plurality of sections also include a third section 54 bent at 90 degrees from the second section parallel with and overlying the first section and spaced from the first section to receive siding. The third section has a third length the same as the second length plus or minus 20 percent.

The plurality of sections also include a fourth section 56 forming a bend of 180 degrees from the third section parallel with the third section. A portion of the fourth section is in facing contact with the third section. The fourth section has a fourth length twice the length of the third length plus or minus 20 percent.

The plurality of sections also include a fifth section 58 extending laterally and interiorly from the fourth section at 25 to 35 degrees. The fifth section has a fifth length the same length as the fourth length plus or minus 20 percent.

The plurality of sections also include a sixth section 60 extending laterally from the fifth section parallel with the first and fourth sections. The sixth section has a sixth length the same length as the fifth length plus or minus 20 percent.

The plurality of sections also include a seventh section 62 bent to extend interiorly at 90 degrees from the sixth section. Finishing nails 63 extend through the seventh section for securement purposes. The seventh section has a seventh length longer than the sixth length.

Figure 4:
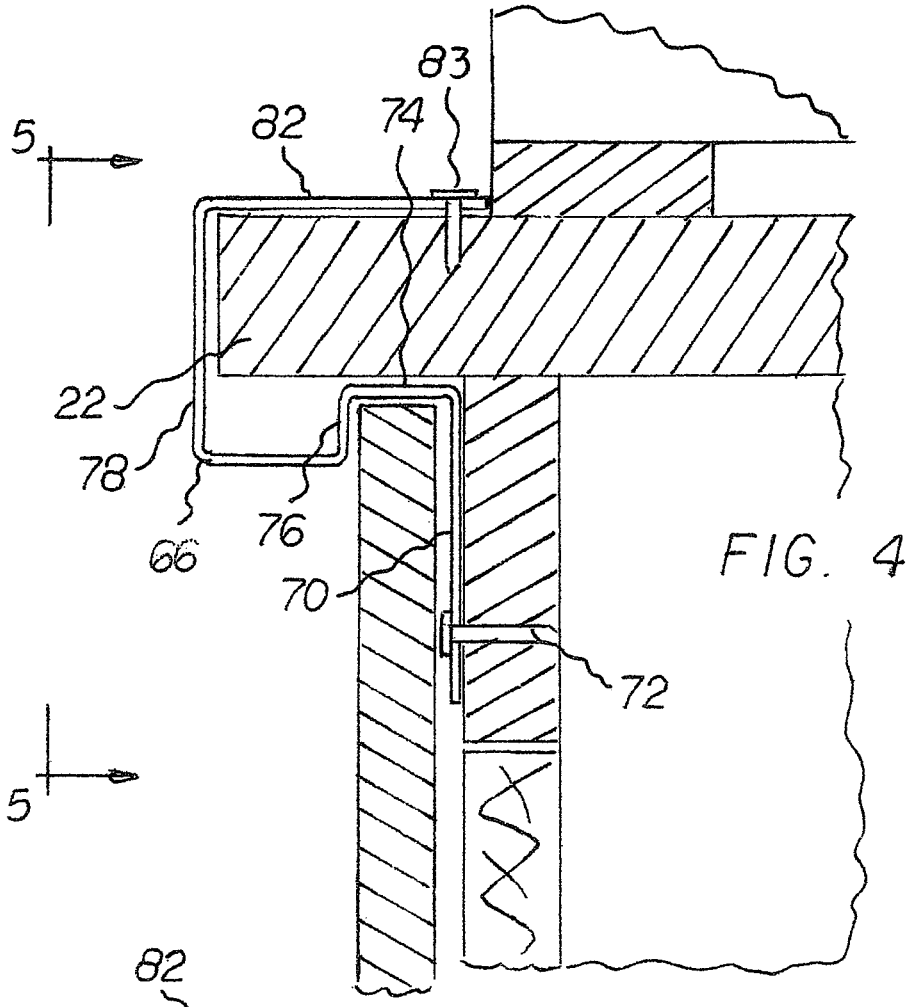
FIG. 4 is a cross sectional view taken along line 4-4 of FIG. 1.
Figure 5:
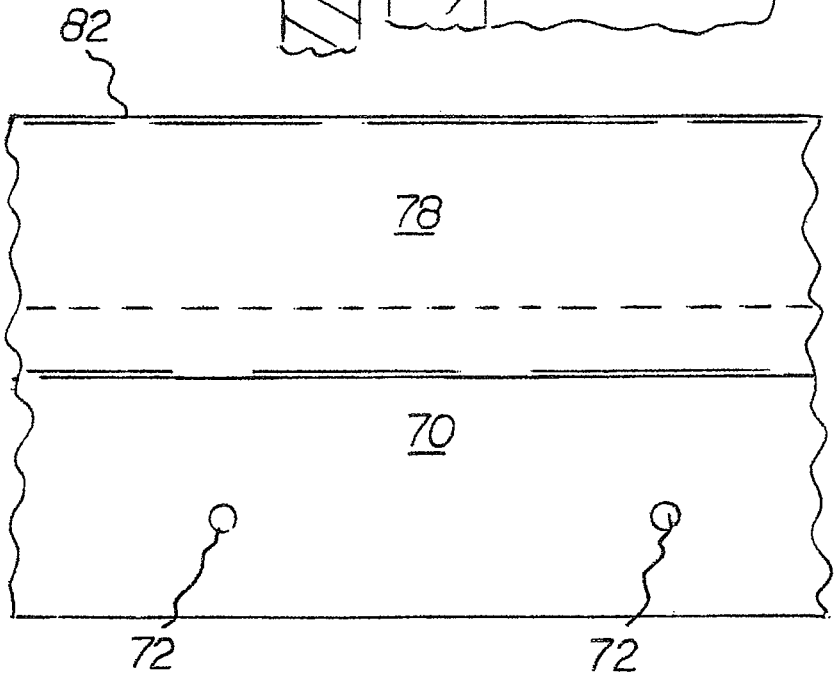
FIG. 5 is a front elevational view taken along line 5-5 of FIG. 4 but with the siding removed.
Figure 25:
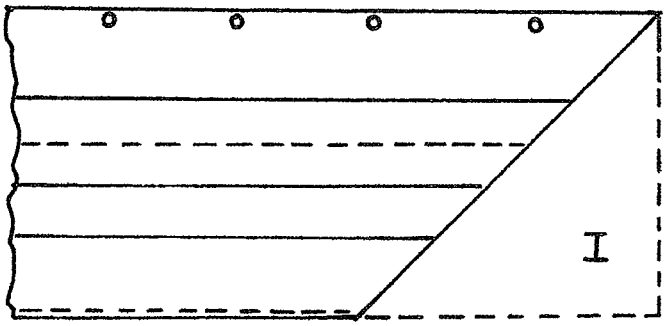
FIG. 25 is a front elevational view of the vinyl siding top marked with area I having been cut.
Figure 26:
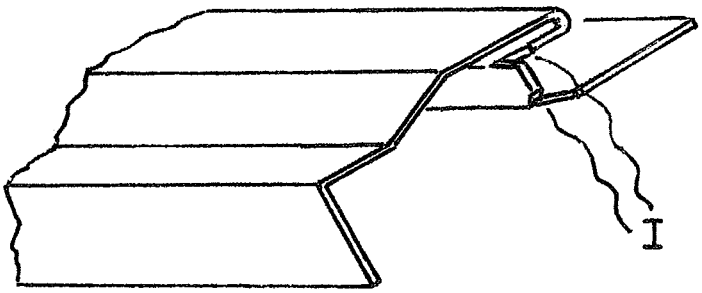
FIG. 26 is a perspective view of the vinyl siding top of FIG. 25 but with area I having been removed.
Figure 27:
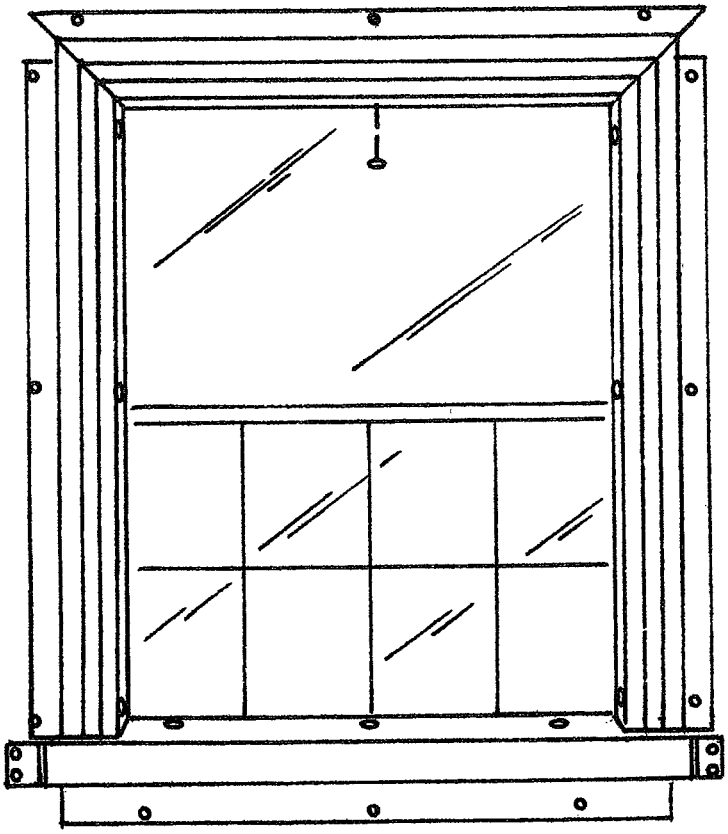
FIG. 27 is a front elevational view of the window of FIG. 23 but with the vinyl siding top nailed thereto.

Next provided is a sill piece 66. The sill piece is coupled to the lower edge. The sill section is bent to form a plurality of regions. Note FIG. 4.

The plurality of regions include a first region 70 in facing contact with the exterior surface of the vertical wall beneath the sill. Roofing nails 72 secure the first region to the exterior surface of the vertical wall beneath the sill. The first region has a first extent.

The plurality of regions include a second region 74 bent to extend exteriorly from the exterior surface of the vertical wall at 90 degrees from the first region. The second region has a second extent less than the first extent.

The plurality of regions include a third region 76 bent at 90 degrees from the second region parallel with and overlying the first region and spaced from the first region to receive siding. The third region has a third extent the same as the second extent plus or minus 20 percent.

The plurality of regions include a fourth region 78 bent at 90 degrees from the third region parallel with the second region. The fourth region has a fourth extent greater than the third extent.

The plurality of regions include a fifth region 80 bent at 90 degrees from the fourth region parallel with the first region and third regions and spaced from the first region to receive siding. The fifth region has a fifth extent greater than the fourth extent.

The plurality of regions include a sixth region 82 bent at 90 degrees from the fifth region parallel with the second and fourth regions and spaced above the sill. Finishing nails 83 extend through the sixth region for securement purposes. The sixth region has a sixth extent greater than the fifth extent.

The plurality of regions include a left end cap 84 going into the left side of the window sill. A right cap 86 going into the right side of the sill. Each end cap is bent to form a plurality of zones. Note FIGS. 7-10.

The plurality of zones include a first zone 88 in facing contact with the exterior surface of the vertical wall beneath the sill with roofing nails securing the first zone to the exterior surface beneath the sill. The first zone has a first width.

The plurality of zones include a second zone 90 bent to extend exteriorly from the exterior surface at 90 degrees from the first zone. The second zone has a second width less than the first width.

The plurality of zones include a third zone 92 bent at 90 degrees from the second zone parallel with and overlying the first zone and spaced from the first zone to receive siding. The third zone has a third width the same as the second width plus or minus 20 percent.

The plurality of zones include a fourth zone 94 bent at 90 degrees from the third zone parallel with the second zone. The fourth zone has a fourth width essentially equal to the third width, plus or minus 20 percent.

The plurality of zones include a fifth zone 96 bent at 90 degrees from the fourth zone parallel with the first zone and third zones. The fifth zone has a fifth width essentially equal to the fourth width plus or minus 20 percent. An upwardly extending notch 98 in the third zone facilitates passage of sill components.

The instructions for installing the above-described vinyl siding window trim system is as follows:

1. With reference to FIGS. 11-13, cut wooden window sill, left and right sides, one inch.

2. Cut wooden window sill, left and right sides, one inch from inside wooden finish board, break off 2 inches A, left and right sides, of the wooden window sill.

3. Cut wooden window sill, left and right sides, one inch from inside the wooden finish board, break off 2 inches A, left and right sides, of wooden window sill. 4. With reference to FIGS. 14-16, measure vinyl siding bottom 45 inches in length.

5. Measure vinyl siding bottom 45 inches in length, cut out 3.5 inches by 0.75 inches, left and right sides, on top of vinyl siding bottom.

6. Cut out C, top of vinyl siding bottom, left and right sides, measure 0.75 inches by 0.75 inches.

7. Cut out D, measure vinyl siding bottom, left and right sides, 1.5 inches by 0.75 inches, cut out D by 0.75 inches.

8. Place vinyl siding bottom over wooden window sill, nail vinyl siding to window sill with 2 or 3 finish nails on top of sill, nail with 2 or 3 roofing nails into 1.5 inches bottom sill into styrofoam installation and structure.

9. With reference to FIGS. 17-19, place 0.75 inch end cap into vinyl siding bottom, left and right sides, place two 1.5 inch roofing nails into end cap into styrofoam installation and structure.

10. Place 0.75 inch end cap into vinyl siding bottom, left and right sides, place two 1.5 inch roofing nails into end caps into styrofoam insulation and structure.

11. With reference to FIGS. 20-23, measure vinyl siding sides, left and right, from window sill from top of window finish board 46 inches in, add 4 inches, total length 50 inches.

12. Cut out 0.75 inches by 4 inches down on top left and right sides.

13. Vinyl siding sides, left and right, cut down 0.5 inches over by 1.25 inches by 1.25 inches by 1.25 inches by 0.75 inches, cut out H.

14. Vinyl siding sides, left and right, cut down 0.5 inches over by 1.25 inches by 1.25 inches by 1.25 inches by 0.75 inches, cut out H.

15. Vinyl siding sides, left and right, measure top 1.5 inches by 0.75 inches, measure down 1.0 inch, cut out.

16. Place vinyl siding sides, left and right over wooden finish board, nail into vinyl siding band finish board with 2 or 3 finish nails, each 2 or 3 roofing nails into styrofoam insulation and structure.

17. With reference to FIGS. 24-27, measure vinyl siding top 46 inches, cut off.

18. Measure top left inside finish board, cut off to point to point to point to point to point, cut off I, cut at 45 degree angle and hook to top finish board, slide to left side.

19. Cut off 0.5 inches on the top, left and right sides, from window trim, to obtain height of sides, slide top to left and cut 0.5 inches more or less and repeat on right side.

20. Place top left side on top of left side, go point to point to point on right side, cut off I.

21. Cut out I a V top left and right inside bottom J-channel front and back 0.75 inches by 0.75 inches, bend over into side J-channel.

22. Place top on top of left on right side, nail with 2 or 3 finishing nails, into finish board E, nail 2 or 3 roofing nails into styrofoam insulation and structure.

23. Multiple colors with or without wood grain finish.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window trim system (10) for installing and supporting trim and siding (12) on a building (14) in proximity to a window 16, the installing and the supporting being done in a structurally enhanced and eye-appealing manner for covering the peripheral region adjacent to the window with enlarged and contoured trim, the system comprising, in combination:

the building (14) having a vertical wall with a window opening (20) in a rectangular configuration, the window opening having an outwardly extending sill (22) below, the vertical wall having an interior surface (24) and an exterior surface (26), the window opening having an upper edge (28), a lower edge (30), a left edge (32) and a right edge (34), a pane of glass (36) supported within the window opening and constituting the window of the building;

a left side piece (40) coupled to the left edge, and a similarly configured right side piece (42) coupled to the right edge, and a similarly configured top piece (44) coupled to the top edge, the top piece and the left side piece and right side piece terminating at 45 degrees, the left side piece and the right side piece and the top piece (40)(42)(44) being bent to form a plurality of sections, the plurality of sections including:

a first section (48) in facing contact with the exterior surface of the building with horizontally extending roofing nails (50) securing the first section to the exterior surface, the first section having a first length, a second section (52) bent to extend exteriorly from the exterior surface at 90 degrees from the first section, the second section having a second length less than the first length, a third section (54) bent at 90 degrees from the second section parallel with and overlying the first section and spaced from the first section to receive siding, the third section having a third length the same as the second length plus or minus 20 percent, a fourth section (56) forming a semi-cylindrical bend of 180 degrees from the third section parallel with the third section, a portion of the fourth section being in facing contact with the third section, the fourth section having a fourth length twice the length of the third length plus or minus 20 percent, a fifth section (58) extending laterally and interiorly from the fourth section at 25 to 35 degrees, the fifth section having a fifth length the same length as the fourth length plus or minus 20 percent, a sixth section (60) extending laterally from the fifth section parallel with the first and fourth sections, the sixth section having a sixth length the same length as the fifth length plus or minus 20 percent, and a seventh section (62) bent to extend interiorly at 90 degrees from the sixth section, horizontally extending finishing nails (63) extending through the seventh section for securement purposes, the seventh section having a seventh length longer than the sixth length;

a sill piece (66) coupled to the lower edge, the sill piece being bent to form a plurality of regions, the plurality of regions including:

a first region (70) in facing contact with the exterior surface of the vertical wall beneath the sill with horizontally extending roofing nails (72) securing the first region to the exterior surface beneath the sill, the first region having a first extent, a second region (74) bent to extend exteriorly from the exterior surface at 90 degrees from the first region, the second region having a second extent less than the first extent, a third region (76) bent at 90 degrees from the second region parallel with and overlying the first region and spaced from the first region to receive siding, the third region having a third extent the same as the second extent plus or minus 20 percent, a fourth region (78) bent at 90 degrees from the third region parallel with the second region, the fourth region having a fourth extent greater than the third extent, a fifth region (80) bent at 90 degrees from the fourth region parallel with the first region and third regions and spaced from the first region to receive siding, the fifth region having a fifth extent greater than the fourth extent, a sixth region (82) bent at 90 degrees from the fifth region parallel with the second and fourth regions and spaced above the sill, vertically disposed finishing nails (83) extending through the sixth region for securement purposes, the sixth region having a sixth extent greater than the fifth extent;

a left end cap (84) projecting into the left side of the sill piece, a right end cap (86) projecting into the right side of the sill piece, each end cap being bent to form a plurality of zones, the plurality of zones including:

a first zone (88) in facing contact with the exterior surface of the vertical wall beneath the sill with roofing nails securing the first zone to the exterior surface beneath the sill, the first zone having a first width, a second zone (90) bent to extend exteriorly from the exterior surface at 90 degrees from the first zone, the second zone having a second width less than the first width, a third zone (92) bent at 90 degrees from the second zone parallel with and overlying the first zone and spaced from the first zone to receive siding, the third zone having a third width the same as the second width plus or minus 20 percent, a fourth zone (94) bent at 90 degrees from the third zone parallel with the second zone, the fourth zone having a fourth width essentially equal to the third width, plus or minus 20 percent, a fifth zone (96) bent at 90 degrees from the fourth zone parallel with the first zone and third zones, the fifth zone having a fifth width essentially equal to the fourth width plus or minus 20 percent, an upwardly extending notch (98) in the third zone to facilitate passage of sill components.

* * * * *